US012435499B2

(12) United States Patent
Bosio

(10) Patent No.: US 12,435,499 B2
(45) Date of Patent: Oct. 7, 2025

(54) FAUCET ASSEMBLY WITH AERATOR CARTRIDGE AND METHOD FOR MOUNTING SAID ASSEMBLY

(71) Applicant: AMFAG S.r.l., Casaloldo (IT)

(72) Inventor: Orlando Bosio, Casaloldo (IT)

(73) Assignee: AMFAG S.r.l., Casaloldo (IT)

( * ) Notice: Subject to any disclaimer, the term of this patent is extended or adjusted under 35 U.S.C. 154(b) by 813 days.

(21) Appl. No.: 17/004,726

(22) Filed: Aug. 27, 2020

(65) Prior Publication Data

US 2020/0392707 A1 Dec. 17, 2020

Related U.S. Application Data

(63) Continuation-in-part of application No. 15/287,628, filed on Oct. 6, 2016, now abandoned.

(30) Foreign Application Priority Data

Oct. 7, 2015 (IT) ..... 102015000059248

(51) Int. Cl.
*E03C 1/084* (2006.01)

(52) U.S. Cl.
CPC ..... *E03C 1/084* (2013.01)

(58) Field of Classification Search
CPC ..... E03C 1/086; E03C 1/084; F16L 15/006
See application file for complete search history.

(56) References Cited

U.S. PATENT DOCUMENTS

| | | | | |
|---|---|---|---|---|
| 3,104,827 | A | 9/1963 | Aghnides | |
| 3,298,614 | A | 1/1967 | Aghnides | |
| 3,851,825 | A | 12/1974 | Parkison | |
| 9,151,026 | B2 | 10/2015 | Wildfang | |
| 2009/0090793 | A1 | 4/2009 | Ichige | |
| 2014/0053332 | A1 * | 2/2014 | Cole | E03C 1/046 4/678 |

FOREIGN PATENT DOCUMENTS

| | | | | |
|---|---|---|---|---|
| GB | 1 282 957 | A | 7/1972 | |
| WO | WO-2011154063 | A1 * | 12/2011 | E03C 1/084 |

OTHER PUBLICATIONS

Bosio, U.S. Appl. No. 15/287,628, filed Oct. 6, 2016, Interview Summary, Aug. 26, 2020.
Bosio, U.S. Appl. No. 15/287,628, filed Oct. 6, 2016, Office Action, Sep. 12, 2018.
Bosio, U.S. Appl. No. 15/287,628, filed Oct. 6, 2016, Office Action, Jul. 30, 2019.

(Continued)

*Primary Examiner* — Jason J Boeckmann
(74) *Attorney, Agent, or Firm* — Knobbe, Martens, Olson & Bear, LLP

(57) ABSTRACT

Faucet assembly with aerator cartridge (1'), which is screwed by means of an attachment thread (12) into the mouth (100), which has no sealing gasket, wherein water (W) seeping through the attachment thread (12) is at least partially reintroduced into a casing (10) of cartridge (1') through suitably positioned aeration windows (13), being dragged by the air flow (A), which is sucked into said aeration windows (13) by the water flow within an internal flow path (2) of said cartridge (1).

6 Claims, 5 Drawing Sheets

(56) References Cited

OTHER PUBLICATIONS

Bosio, U.S. Appl. No. 15/287,628, filed Oct. 6, 2016, Interview Summary, May 10, 2019.
Bosio, U.S. Appl. No. 15/287,628, filed Oct. 6, 2016, Final Office Action, Apr. 1, 2020.
Bosio, U.S. Appl. No. 15/287,628, filed Oct. 6, 2016, Final Office Action, Jan. 22, 2019.
Ministero dello Sviluppo Economico, "Search Report" in application No. I0 59148, dated Jun. 2, 2016, 2 pages.

* cited by examiner

FAUCET ASSEMBLY WITH AERATOR CARTRIDGE AND METHOD FOR MOUNTING SAID ASSEMBLY

BENEFIT CLAIM

This application claims the benefit under 35 U.S.C. § 120 as a Continuation-in-part of application Ser. No. 15/287,628, filed Oct. 6, 2016, which claims the benefit of Italy application 102015000059248, filed Oct. 7, 2015 the entire contents of which is hereby incorporated by reference for all purposes as if fully set forth herein. The applicants hereby rescind any disclaimer of claim scope in the parent applications or the prosecution history thereof and advise the USPTO that the claims in this application may be broader than any claim in the parent applications.

DESCRIPTION

Field of the Invention

The present invention refers to a faucet assembly with an aerator cartridge, in particular of the type which can be hidden, i.e. which is completely insertable into the mouth of the same faucet. The present invention also refers to a method for mounting the aerator cartridge in its seat.

Above said devices are advantageously used in the field of faucets and faucet accessories.

Known Art

Aerator devices are already largely used, in disparate home water installations, which, after being mounted on fluid outlets from the grid, in particular on faucet mouths, allow avoiding liquid seepage and homogenization of outpouring water, by mixing it with air, so that a full and regular jet is obtained. Such devices, since they achieve the jet required by users with less water flow, provide important reductions both of water usage and energy consumption due to water heating.

Increasingly, such devices are no more inserted into an additional ring nut, but are instead directly inserted into the terminal tract of the faucet, which is suitably threaded in order to allow a threaded connection inside the same. This mounting method allows the aerator cartridge to be almost invisible, and is therefore particularly preferred, since it does not negatively influence the faucet's appearance.

In such embodiments, it is known to be necessary to avoid any seepage of fluid at the threaded coupling between cartridge and inner conduit of faucet. Such occurrences, although not impairing the operation of faucet, cause, during use, a persistent lateral non homogeneous dripping with respect to delivered jet; this is esthetically displeasing and commercially unacceptable.

In order to avoid such seeping, products in the known art always provide at least a sealing gasket at or near the threaded connection. Depending on the embodiment, the cartridge, which is screwed into the terminal male threading of the faucet tube may or may not abut against an abutting or end stop. In the first case a flat compressed gasket is introduced between cartridge and end stop; in the second case, a toroidal gasket is positioned near the threaded connection, clamped between the inner surface of faucet and an external groove of cartridge.

WO 2011/154063 discloses both the above said sealing systems: FIGS. 3-6 show the use of a flat gasket, which is clamped between the cartridge and the shoulder of faucet;

FIGS. 7-11 show the use of a peripheral toroidal gasket, which is introduced into a peripheral groove of same cartridge.

In both cases, in any case, mounting and in particular dismounting operations are very complicated due to the presence of the elastic gasket.

In particular, if the gasket is compressed against the upper abutment, it is necessary to strongly tighten the cartridge, in order to ensure a good water resistance of the connection; if, on the other hand, a toroidal gasket is applied between the cartridge and the inner wall, this causes a high friction and, with time, adhesion phenomena, which hinder the removal of the same cartridge. The extraction of the cartridge by the user, which is necessary in case of service and replacement, require the application of a high torque, and cannot be done with bare hands.

In order to eliminate this drawback, the aerator cartridge is also provided with a specific wrench, which has to engage from the underside the object which is inserted into the faucet tube. On the other hand, it is clear that such a mounting wrench has a non irrelevant price tag, and also represents an element which is often lost by the user, because of its infrequent use.

The difficulty in inserting the elastic sealing element into the mounting seat, the necessity of a periodic service as well as, and foremost, the need to provide an expansion inner counter-groove in the thin wall of faucet tube represent further important drawbacks, which are still unsolved in the embodiments of the known art.

In the past, alternative sealing systems have been proposed for faucet aerators without elastic gaskets.

U.S. Pat. No. 3,298,614 proposes, for example, various technical solutions in this direction. The majority of them provide a septum or a flange of plastic material, which, abutting against a mouth's abutment surface, defines a relatively water resistant sealing, due to strong tightening of the entire cartridge. Other solutions provide the use of a metallic element, which radially forces in an outward direction the thin wall of plastic material on which the cartridge's threading is provided, to achieve the sealing due to radial interference between screwed threads. In both cases, the solution provides the only advantage of a cost reduction of gasket, without solving, or even increasing, the difficult removal of the cartridge due to high tightening torque.

Prior documents U.S. Pat. No. 3,104,827 and GB 1 282 957 refer to other embodiments of a faucet assembly, in which the sealing of cartridge is ensured by a head gasket and/or by rigid abutments, which is strongly tightened against a shoulder of the mouth.

The technical problem to be solved by the present invention is therefore to provide a hidden aerator cartridge, which does not have the drawbacks of the known art, and in particular, which allows the prevention of a lateral dripping without requiring tightening torques, which are so high as to hinder a manual extraction of the cartridge.

SUMMARY OF THE INVENTION

The above said technical problem is solved by a faucet assembly comprising: a mouth with an internally threaded portion; and an aerator cartridge, which is inserted into said mouth, wherein said cartridge defines an internal flow path from an upstream inlet and a downstream outlet; wherein said cartridge comprises: a casing, at least one jet breaking means, which is positioned in such a way as to intercept said internal flow path, wherein said casing has an external lateral surface, which is provided with an attachment thread, which is screwed into said internally threaded portion of said mouth, for defining a threaded coupling and with at least one aeration window, opening on the internal flow path, wherein said aeration window is positioned at or underneath the attachment thread, directly contacting the same or being joined with the same by means of a continuous profile of external lateral surface.

The above said jet breaking means may be positioned inside said casing. It may comprise one or more sieves, which are disposed inside the casing, or which may even be completely integrated in said casing, for example as a lower grating.

Advantageously, in the faucet assembly according to the invention, no sealing gasket is provided for avoiding water seeping through said threaded coupling between the mouth and the cartridge, so that the torque required for unscrewing may be minimal, since it has only to overcome the friction between the threads of the threaded coupling.

In particular, in order to allow a manual unscrewing of cartridge, the required torque for unscrewing of said threaded coupling is kept under 1 Nm, preferably under 0.5 Nm, and more preferably under 0.3 Nm. Ideally, such a torque may be kept at a negligible level, i.e. it may be limited only to the torque required for overcoming sliding friction between the thread's surfaces, which are mutually engaged with a certain play.

The required unscrewing torque, as defined in the present application, is measured on a knew item, at a time directly following the screwing, i.e. before adhesion phenomena, which are due to limestone depositing during the faucet's use, may influence its value.

With reference to terms used above, the aeration window may be considered to be at the thread, if it opens at least partially above he lower edge of the same thread, locally interrupting the same; underneath the thread in all other cases.

With reference to terms used above, the aeration window may be considered to be directly contacting the attachment thread if the lower edge of thread is at least partially adjoining a portion of the edge of the aeration window. The aeration window is joined, by means of a continuous profile, to the external lateral surface if, between at least a portion of the lower edge of thread and at least a portion of the edge of the aeration window, the profile does not feature ridges or troughs, that may cause the separation of the water drop which flows, through gravity, from the lower edge of thread to the inlet into the window opening.

In other words, it is necessary that the shape of the lateral external surface and the arrangement of the aeration windows with respect to the attachment thread be such as to not hinder the flow of water, which has seeped through the attachment thread towards the at least one aeration window.

In above said faucet assemblies, the applicant has observed that the expected drippings due to seepage of water through the threaded coupling without the peripheral gasket are considerably reduced and almost vanish.

The cause of this effect, totally surprising and unexpected even for the skilled in the art, is interpreted in the following, which is only an hypothesis without pretending to be neither exhaustive nor scientifically correct.

As shown in FIG. 6, the flow of water through the cartridge defines, according to known Bernoulli equation, a local depression which sucks ambient air through the aeration windows, which are laterally positioned with respect to the same flow. It is argued, that such a sucking effect is sufficient to drag the water droplets, who have seeped towards the aeration windows, therefore reintroducing the same into the path of primary flow of aerator.

Tests conducted by the applicant have in particular shown that, in case of small sized aerators (with a diameter equal or less than 24 mm), the aeration windows, which are positioned against of thread provide the total suppression of the dripping phenomenon, even without the traditional sealing gaskets.

Similar results have been obtained also with aeration windows positioned away from the thread (not illustrated), in particular in case of a continuous joining surface.

On the other hand, FIG. 7 shows an example of a discontinuity between the aeration opening and the threaded surface. In this case, the flow seeping through the thread cannot slide along the casing until it reenters the cartridge, but is instead broken at the discontinuity, causing the dripping effect, which is avoided by the present invention.

One can therefore understand that the presence of the aeration windows in the cartridge casing is, per se, not sufficient to determine the described phenomenon of dripping recovery, since it is also required to have a contiguity between these and the thread or the superficial continuity of the interposed coupling.

It is in particular to be noted, that the absence of sealing gaskets implies the absence of grooves and similar enclosing formations, which are traditionally provided on the lateral surface of cartridge at or near the attachment thread.

The device according to the invention therefore defines an alternative sealing system, which is also considerably simplified with respect to providing the toroidal gaskets of the art.

The advantages deriving from the absence of sealing gaskets are considerable and readily comprehended by the skilled in the art: material reduction, ease of mounting and in particular dismounting of the device, simplification of the cartridge's structure and of the machining of the mouth portion of faucet, which, in this particular case, does not require a counter-groove for radial expansion of elastic gasket.

In the same way, the cartridge is not required to abut against a shoulder inside the mouth, nor is a flange required to abut against the perimeter of the same mouth, as in the known art, for avoiding dripping through axial tightening with or without interposed gaskets. The cartridge is preferably freely screwed in a male thread of tube, without abutting against any end stop.

It is therefore possible to screw the aeration cartridge in its seat without high friction caused by interposed gaskets and/ or the need for a axial sealing tightening, observing above said limit for the unscrewing torque. Therefore, it is possible to manually mount and dismount the cartridge, i.e. without using any mechanical tool for inferiorly engaging the element.

The cartridge may advantageously comprise suitable elements, like for example protrusions, which are accessible from outside the faucet in the mounted position, in order to facilitate manual unscrewing by the user.

In the faucet assembly according to the present invention the aeration cartridge is in fact preferably of the hidden type, i.e. the axial extension of said casing is completely or predominantly (for the most part) inserted into said mouth.

The threaded coupling, since lacking the gasket, allows a water seepage when said faucet assembly is connected to a water grid with an operating pressure of at least 0.5 bar, preferably 1 bar.

However, water seeped through the threaded coupling is at least partially sucked into the casing of the cartridge through said aeration windows, as previously described. Preferably, seeped water is completely sucked when operating pressure is kept between 0.5 and 6 bar.

Some of the detailed characteristics of the cartridge, relating to preferred and particularly advantageous solutions, are provided in the following.

As already stated, the aeration windows may open either at the lower edge of the attachment thread; or at least partially above the lower edge of attachment thread, locally interrupting the same; or still separated from that edge. In this last case, the external lateral surface has to be provided with a continuous profile, i.e. without interposed drop-breaking formations, between the lower edge of attachment thread and the one or more aeration windows.

The shape of the external lateral surface and the arrangement of aeration windows, in particular with reference to the position of the attachment thread, are, as already noted, structured in a way that, during use, the flow of water along the internal flow path facilitates the sucking of air through the aeration windows, which is sufficiently strong to drag, at least partially, the water seeped from the attachment thread within the casing through said aeration windows.

In particular, experiments conducted by the applicant have shown a complete remission of the dripping phenomenon at pressures compatible with those of a normal water distribution grid, i.e. between 0,5 and 6 bar.

It is to be noted that said casing may comprise a plurality of parts, since the attachment thread and the aeration windows may be provided on separate parts of said casing. The casing may, for example, comprise a cup-shaped body, which is surmounted by a lid or plate, in which jet breaking openings are defined. The attachment thread and the aeration windows may in this case be completely provided on the external surface of the cup-shaped body, or they may be completely or partially provided on the upper part defining the lid.

It is to be noted that the jet breaking means of cartridge are preferably a plurality, and normally comprise at least one plate provided with a jet breaking opening, on whose downstream side one or more sieves are positioned. The jet breaking openings divide the water flow into a plurality of concentrated high speed jets. Speed then decreases when the same jets impact against the underlying sieves. The aeration windows preferably open between the plate with the breaking openings, and the sieves, wherein the flow speed is higher and therefore the sucking effect of ambient air is also higher.

Preferably, the aeration windows are more than one, for example four, and are angularly equally spaced along the periphery of the external lateral surface.

They preferably have a rectangular or trapezoidal shape.

The opening of the aeration windows occupies a considerable portion of the entire circumference of the casing at their location, preferably larger than 25%.

Best results regarding the reduction of dripping have been obtained with aeration cartridges having relatively small dimensions, i.e. a diameter of the attachment thread indicatively equal or less than 24 mm, more preferably less than 20 mm.

The casing preferably comprises at least one cup-shaped lower body, wherein said flow breaking means comprise a plurality of sieves, which are introduced into said cup-shaped body. The cup is inferiorly closed by a lower grating or by one of same sieves. Alternatively, as said, the breaking means may be provided in another way, for example it may be only comprised of the lower grating of cup.

The cup-shaped body preferably has an upper portion comprising the attachment thread, although the latter may be provided on a separate portion as, for example, a lid, which is integrated with the flow breaking plate. The cup-shaped body also comprises a lower containment portion for sieves, and a tapered joining portion between the previous two, wherein the aeration windows partially or completely open on said tapered portion.

The jet breaking means may also comprise a plate, which is provided with jet breaking openings, which plate closes the cup-shaped body on its upper side, wherein said plate is surmounted by a jet breaking screen.

Preferably, the plate engages above the cup-shaped body with a snap fit and the jet breaking screen also engages with a snap fit an upper niche of the same plate.

The above said technical problem is also solved by a method for mounting an aerator cartridge of above said type, comprising the steps of:

Providing an aerator cartridge comprised of a casing and at least one jet breaking means, which is positioned in a way to intercept an internal flow path, said casing being provided with an external lateral surface, which is provided with an attachment thread and, at or under said attachment thread, at least one aeration window, which opens on the internal flow path;

Providing an internally threaded portion on a mouth of the faucet;

Screwing, without interposing any sealing gasket between cartridge and mouth, the attachment thread into said internally threaded portion, with a tightening force lower than 1 Nm, preferably lower than 0.5 Nm, and more preferably lower than 0.3 Nm.

Advantageously, such a method may be put into practice without the help of mechanical tools for temporarily engaging the aerator cartridge.

Further characteristics and advantages can be better understood from the following detailed description of some preferred non exclusive embodiments, of the present invention, with reference to attached figures, which are provided as non limiting examples.

DETAILED DESCRIPTION

With reference to appended FIGS. 1-5, 1 generally indicates a first embodiment of the aerator cartridge.

Figure 1:
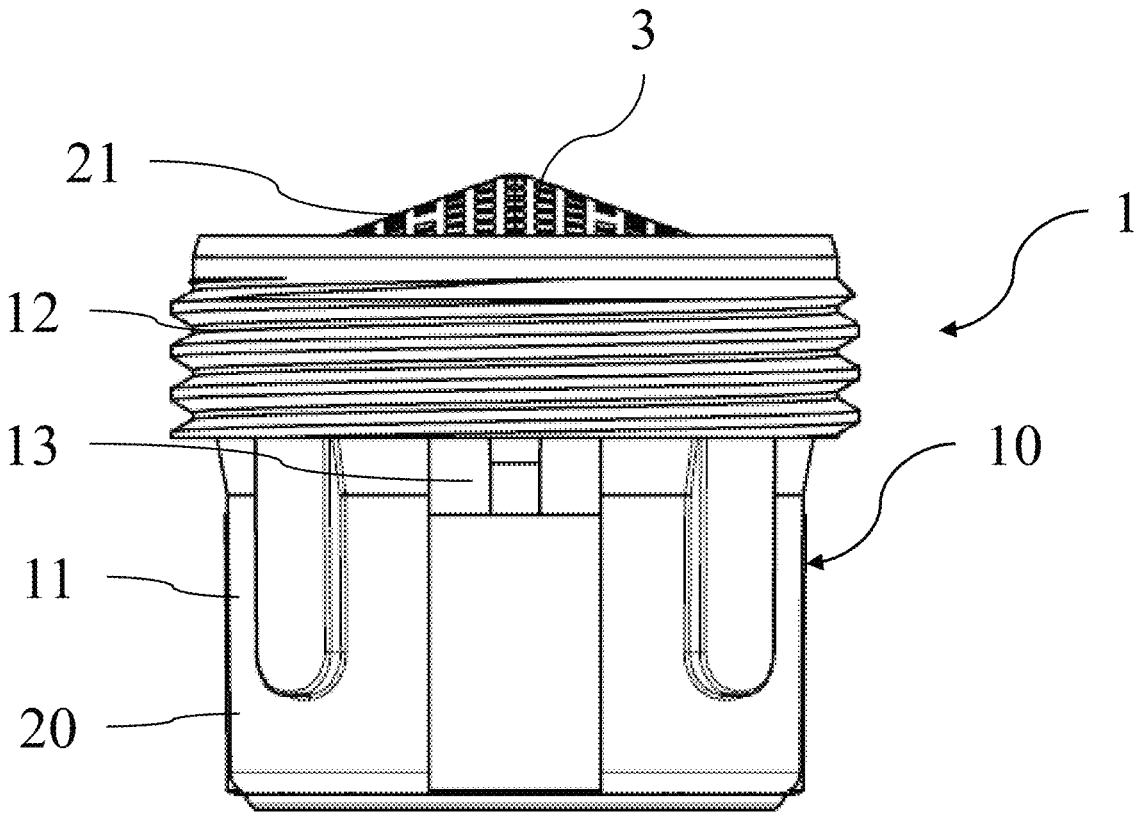
FIG. 1 is a front view of a first embodiment of the aerator cartridge, which is part of a faucet assembly according to the present invention.
Figure 2:
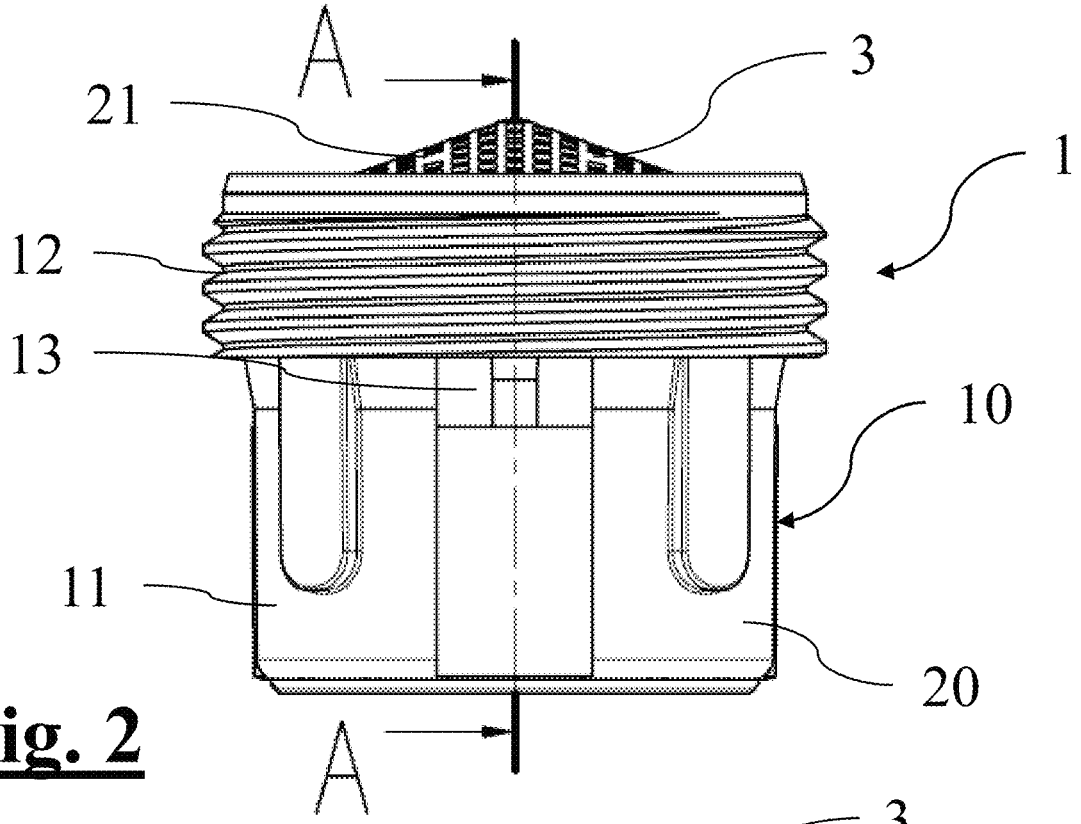
FIG. 2 is a side view of aerator cartridge according to FIG. 1.
Figure 3:
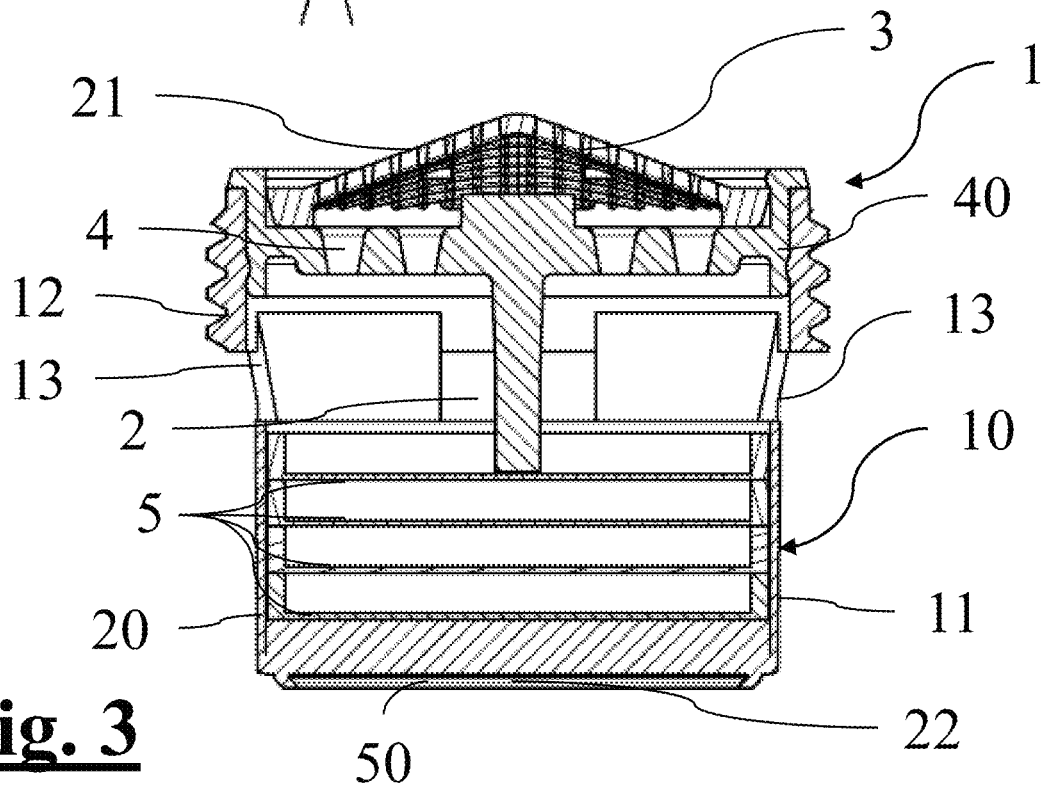
FIG. 3 is a side view of aerator cartridge, in a section along plane A-A of FIG. 2.
Figure 4:
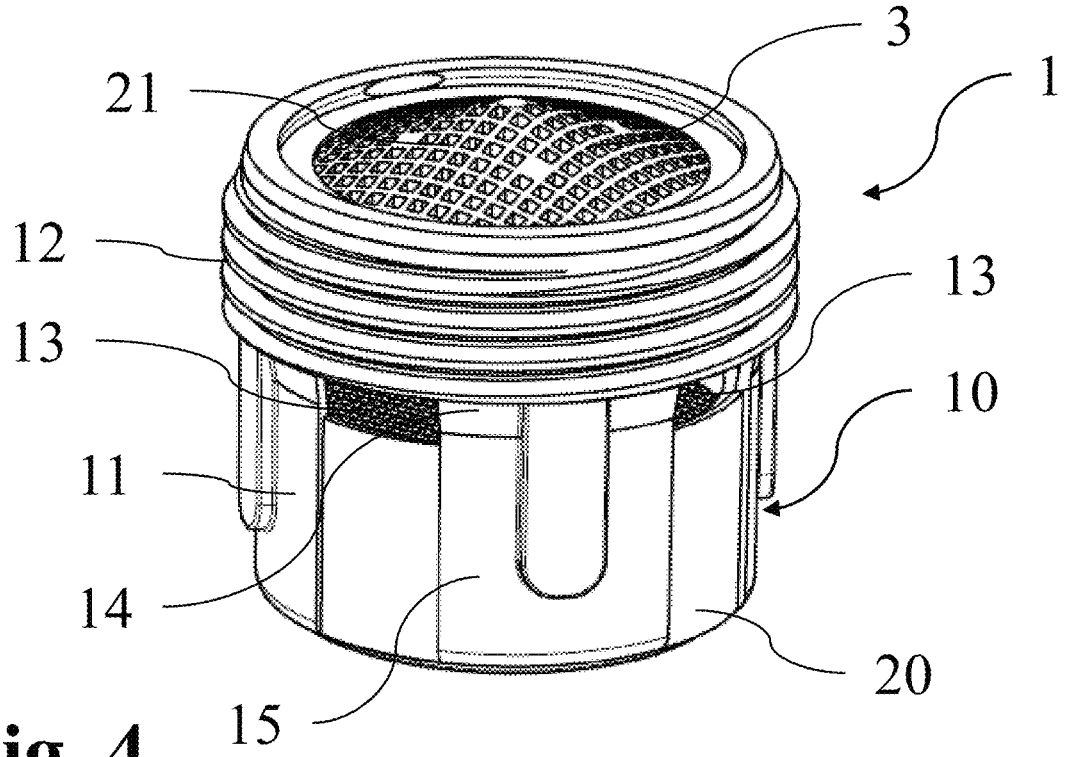
FIG. 4 is a perspective view from above of aerator cartridge of FIG. 1.
Figure 5:
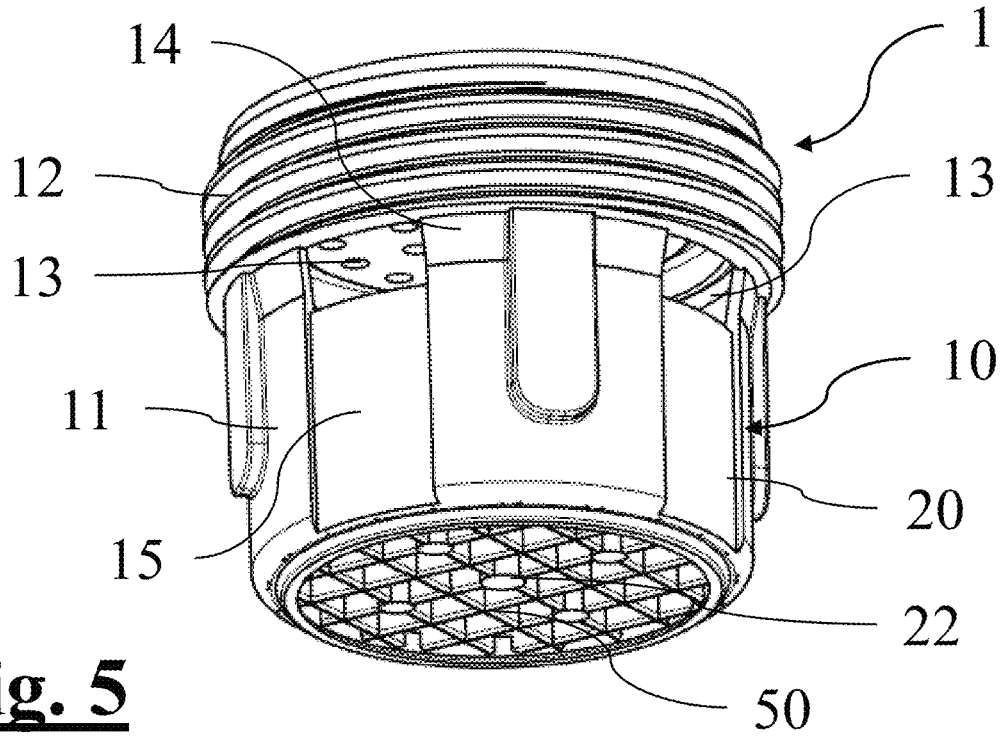
FIG. 5 is a perspective view from below of aerator cartridge of FIG. 1.
Figure 6:
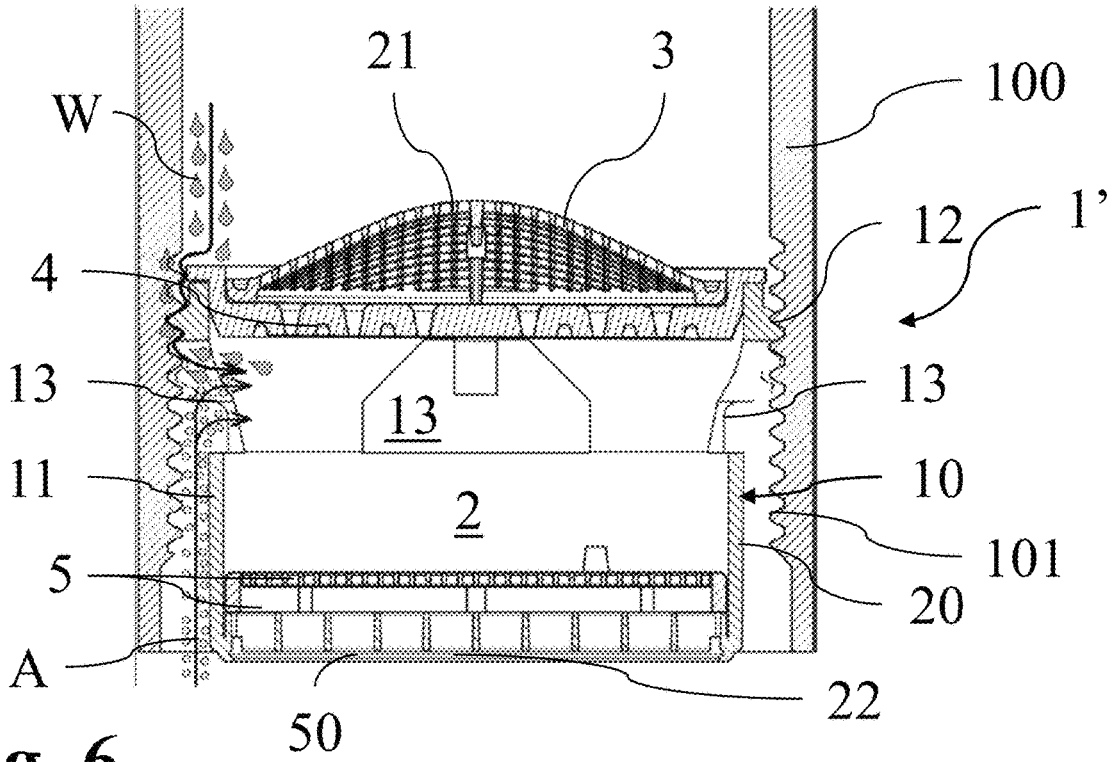
FIG. 6 is a sectional view of a second embodiment of the aerator cartridge being part of a faucet assembly according to the present invention and of the tract of the faucet in which it is housed.
Figure 7:
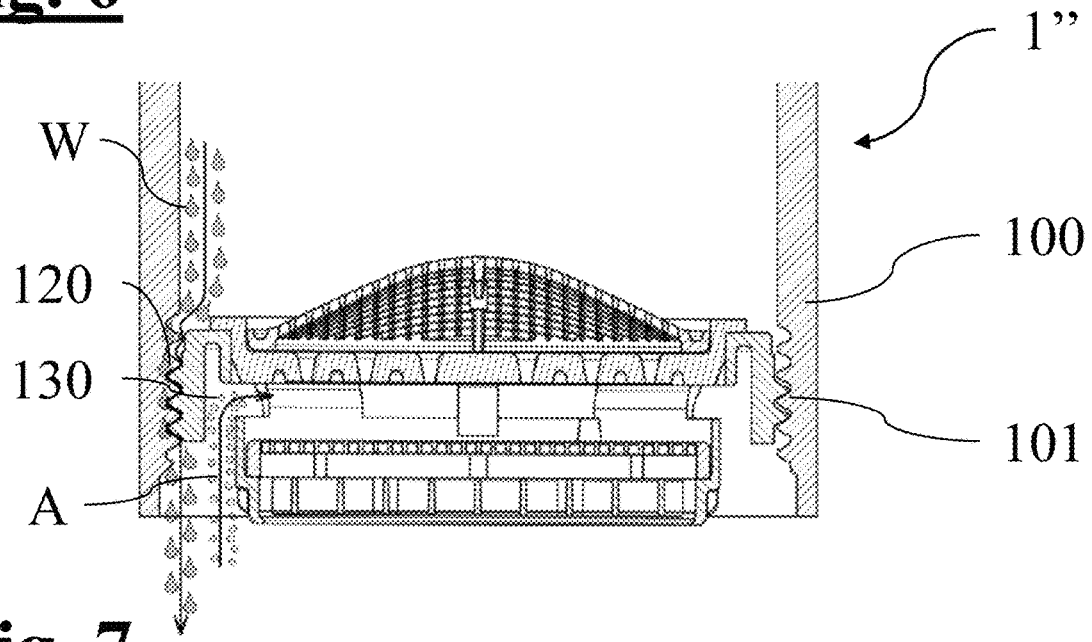
FIG. 7 is a sectional view of an example of an aerator cartridge, which is part of a faucet assembly according to the present invention, and of the tract of the faucet in which it is housed.

On the other hand, 1' indicates the second embodiment of an aerator cartridge of FIGS. 6 and 1" indicates the example of an aerator cartridge, belonging to the invention, which is shown in FIG. 7. In these last two figures, the cartridge shown is housed in an operative position inside a terminal tract of a faucet, which in the following is indicated as mouth 100.

Figure 8:
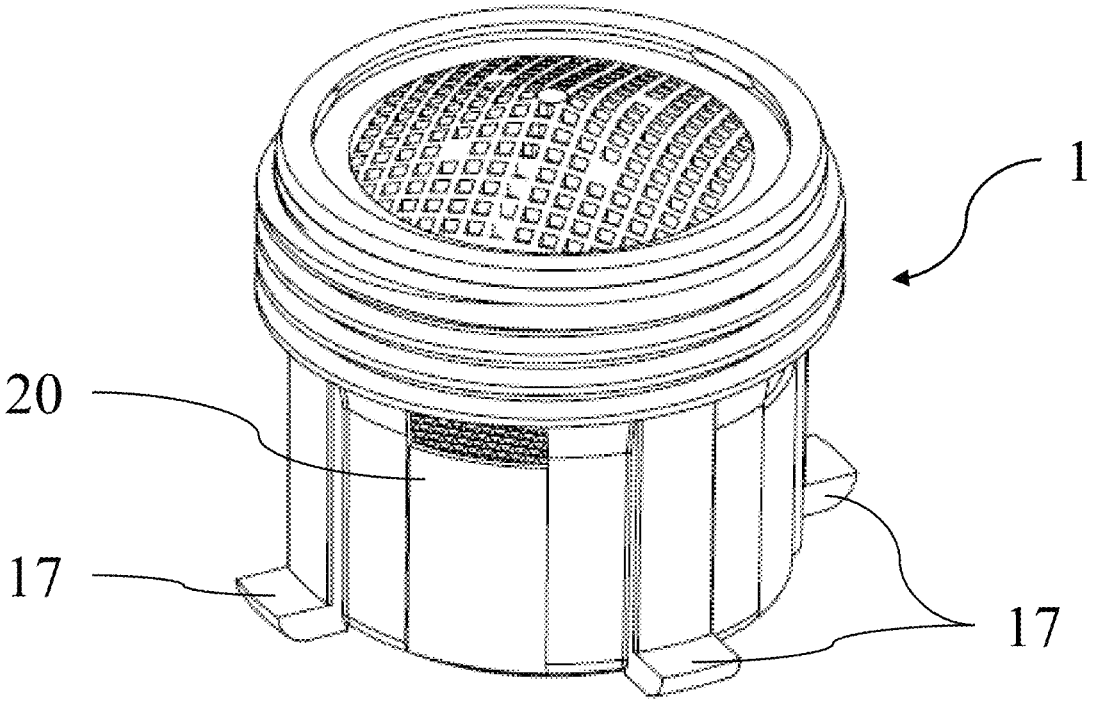
FIGS. 8 and 9 are two views of a lateral jet breaking cartridge, which is part o a faucet assembly according to the present invention, which is provided with specific protruding projections for manual unscrewing of the same.
Figure 9:
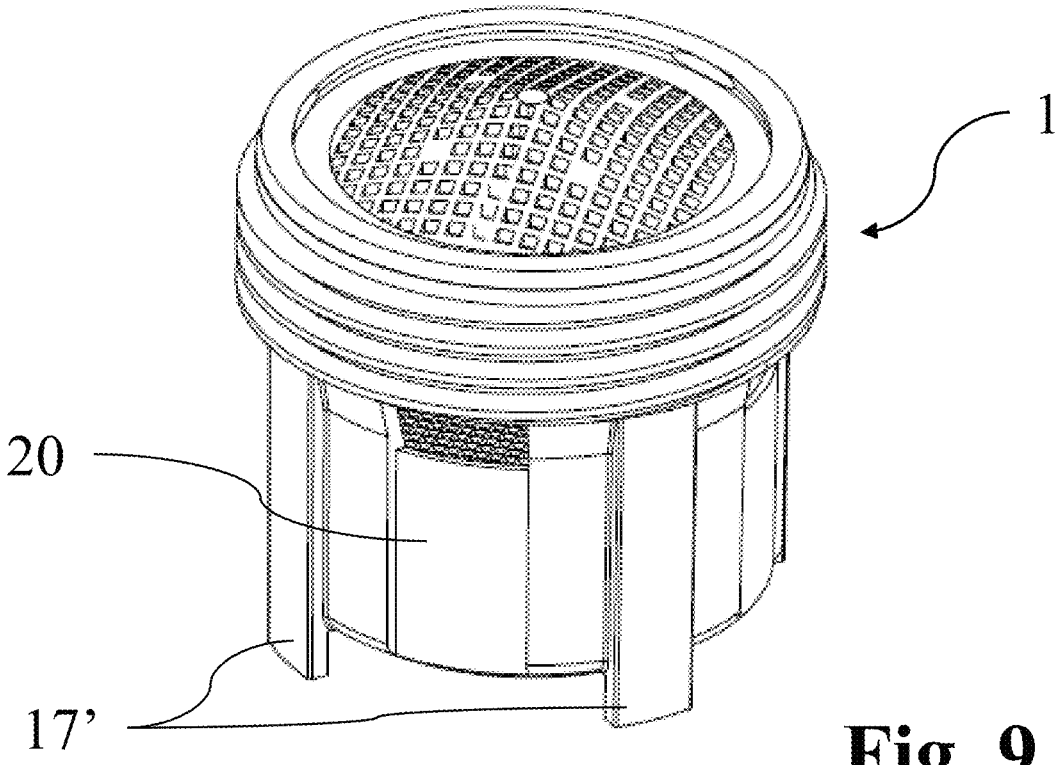

FIGS. 8 and 9 finally show two variants of cartridge 1 according to the first embodiment, which are provided with special protruding projections for manually unscrewing the same cartridge.

The invention refers to a faucet assembly comprising one of cartridges 1, 1'; said faucet comprises a primary portion, which is not shown in appended figures, since it is known per se, which ends with a mouth 100 provided with an internally threaded portion 101, as shown in FIG. 6, in which the cartridge 1, 1' is screwed.

Cartridges 1, 1' and 1" are shown in FIGS. 1-3, 6-9 according to a specific vertical operative configuration; in the following description, positions and orientations, relative and absolute, of various elements comprising the unit, defined by terms such as upper and lower, up and down, horizontal and vertical or other equivalent terms, have always to be interpreted with reference to such a configuration. Therefore, they should not be provided with any limiting value; on the contrary, the cartridges are installed, in the majority of cases, according to an inclined configuration with respect to the vertical direction.

In the first embodiment, shown in FIGS. 1-5, cartridge 1 of the aerator is composed of a plurality of elements, which are removably associated to each other.

In particular, a casing 10, which is inferiorly defined by a cup-shaped body 20, internally containing a plurality of sieves 5—in this particular case four —, which lie on a bottom grating 50, an upper lid 40, which snappingly engages, above the cup-shaped body 20, defining a plate 4, which is crossed by a plurality of frustoconical jet breaking openings, and lastly a jet breaking screen 3, which snappingly engages above the plate 4.

Above said elements define an internal flow path 2 for water, which is emitted by a faucet, which is provided with the device. The internal flow path extends from a upstream inlet 21, coinciding with the jet breaking screen 3, and a downstream outlet 22, coinciding with the bottom grating 50.

The cup-shaped body 20 is provided, on an upper portion of its external lateral s internal surface 11 with an attachment thread 12, which, in the present embodiment, has a diameter of 16 mm and a pitch of 1 mm. The thread, which extends for four rotations along an overall height of 4 mm, is operable for screwing inside the internal threaded portion 101 of mouth 100 of faucet assembly.

The attachment thread 12 extends to the upper end of cup-shaped body 20, and is surmounted only by a small attachment flange of upper lid 40. In particular, the absence of a receiving groove for a sealing gasket may be noted.

Underneath the upper portion, which is necessarily cylindrical, the casing is provided with a tapered portion 14, which joins the attachment thread 12 with an underlying lower portion 15, which is also cylindrical, in which the piled sieves 5 are enclosed.

The cup-shaped body 20 of casing 10 is provided with four aeration windows 13, which are equally angularly spaced, and have an essentially rectangular shape, whose height covers the entire extension of tapered portion 14. The aeration windows 13 are therefore positioned immediately against the attachment thread 12, i.e. their opening is directly underneath the lower edge of attachment thread 12.

In the alternative embodiment of FIG. 6, the aerator cartridge 1' essentially has the same components and principal characteristics of the first embodiment, which was previously described. Such components and characteristics are therefore indicated by reference numerals previously used.

The only substantial difference between the two embodiments refers to the upper extension of aeration windows 13, which, in this case, surmounts the lower edge of attachment thread 12, so that interrupts the latter.

FIG. 6 also shows the operating principle on which the present invention is based. When the emitted water flow passes through the flow path 2, it generates a local depression, which sucks an air flow A from the aeration windows. Also water W seeped through the threaded coupling is dragged, together with it, into the aerator cartridge 1, reconnecting with the water flow, which is emitted by the bottom grating 50.

FIG. 7, on the other hand, shows that the simple provision of aeration window 130 does not suffice to cause the required effect, if an abrupt transition between the threaded coupling 120 and the same aeration windows is provided. In fact, in this case, the air flow A, which is sucked into the device, is not able to drag the seeped water W along the thread.

FIGS. 8 and 9 finally refer, as previously indicated, to variants of the previously described aerator cartridge 1. In these variants, protruding flaps 17; 17' are provided, which are outwardly and downwardly directed, respectively, with respect to the lower portion of cup-shaped body 20, and which remain accessible to the user even if the cartridge 1 is in the mounted position, defining an application surface, which facilitates the manual unscrewing of the device.

The mounting of presently described cartridges 1, 1' into the mouth 100, in order to complete the faucet assembly, comprises the screwing of the attachment thread 12 into the internally threaded portion 101 of the same mouth. Since no sealing tightening or toroidal gaskets are provided, that generate additional friction, screwing may be accomplished using a minimal tightening torque, lower than 0.5 Nm, for example. In particular, the same can be accomplished manually without using tightening tools, the user directly gripping the lower end of casing 10 with her fingers.

Obviously, the skilled in the art, in order to meet contingent and specific needs, may introduce various modifications and variants to the invention, which, by the way, are all contained within the protection scope of the invention, as defined in the following claims.

The invention claimed is:

1. A faucet assembly comprising:

a mouth with an internally threaded portion; and an aerator cartridge, which is inserted within said mouth, said cartridge defining an internal flow path from an upstream inlet to a downstream outlet; said cartridge comprising:

a casing; and at least one jet breaking element positioned to intercept said internal flow path, said casing being provided with an outer lateral surface provided with an attachment thread, which is screwed into said internally threaded portion of said mouth, such as to define a threaded coupling and at least one aeration window directly opening on the internal flow path, said aeration window being positioned at or underneath the attachment thread, directly contacting the same or joined to the same by a continuous profile of the outer lateral surface;

wherein no sealing gasket is provided for preventing water seeping through said threaded coupling between the mouth and the cartridge;

wherein an axial extension of said casing is completely or predominantly inserted within said mouth;

wherein an interspace is provided, underneath the threaded coupling, between the outer lateral surface of the casing and an inner surface of said mouth;

wherein said at least one aeration window opens at a distance from a lower opening of said mouth, the aeration window being in fluid communication with said interspace, so that the interspace defines an air passage from the lower opening of said mouth towards the aeration window;

wherein said cartridge is not abutting against an internal shoulder of the mouth;

wherein, during use, when the faucet assembly is connected to a water grid with an operating pressure between 0.5 and 6 bar, said threaded coupling allows water seeping, and when said water grid has an operating pressure between 1 bar and 6 bar, water seeping through said threaded coupling between the mouth and the cartridge is completely sucked into the casing of the cartridge through said at least one aeration window and all of the water seeping through said threaded coupling between the mouth and the cartridge rejoins the internal flow path;

wherein the internal flow path is entirely internal to the aerator; and wherein a tightening torque required for unscrewing said threaded coupling is lower than 1 Nm.

2. The faucet assembly according to claim 1, wherein the at least one aeration window opens at a lower edge of the attachment thread.

3. The faucet assembly according to claim 1, wherein said at least one aeration window belongs to a plurality, equally angularly spaced along a periphery of the outer lateral surface.

4. The faucet assembly according to claim 1, wherein a diameter of the attachment thread is equal or less than 24 mm.

5. The faucet assembly according to claim 1, wherein said casing comprises a cup-shaped body.

6. The faucet assembly according to claim 1, wherein said cartridge is not provided with a flange abutting against a perimeter of the mouth.

* * * * *